US008665583B2

(12) United States Patent
Kinsley et al.

(10) Patent No.: US 8,665,583 B2
(45) Date of Patent: Mar. 4, 2014

(54) SHELVING SYSTEM

(76) Inventors: Mark Kinsley, Chicago, IL (US); Robert Kinsley, Elmhurst, IL (US)

( * ) Notice: Subject to any disclaimer, the term of this patent is extended or adjusted under 35 U.S.C. 154(b) by 109 days.

(21) Appl. No.: 13/106,811

(22) Filed: May 12, 2011

(65) Prior Publication Data

US 2011/0279951 A1 Nov. 17, 2011

Related U.S. Application Data

(60) Provisional application No. 61/333,881, filed on May 12, 2010.

(51) Int. Cl.
*A47F 5/08* (2006.01)

(52) U.S. Cl.
USPC ..... 361/679.01; 211/150; 361/679.21

(58) Field of Classification Search
USPC ..... 361/679.01, 679.21; 211/134, 135, 144, 211/186, 187, 188, 149, 150, 151, 153
See application file for complete search history.

(56) References Cited

U.S. PATENT DOCUMENTS

| | | | | | |
|---|---|---|---|---|---|
| D95,043 | S | * | 4/1935 | Kent | D6/574 |
| 2,169,290 | A | * | 8/1939 | Rossi | 40/765 |
| 3,151,576 | A | * | 10/1964 | Patterson | 108/2 |
| 4,041,630 | A | * | 8/1977 | Holbrook | 40/765 |
| 4,709,891 | A | * | 12/1987 | Barnett | 248/214 |
| 4,729,183 | A | * | 3/1988 | Tarter et al. | 40/766 |
| 4,821,437 | A | * | 4/1989 | Abramson et al. | 40/658 |
| 5,128,662 | A | * | 7/1992 | Failla | 345/1.3 |
| 5,220,952 | A | * | 6/1993 | Beaulieu | 160/231.1 |
| 5,408,775 | A | * | 4/1995 | Abramson et al. | 40/655 |
| 5,408,936 | A | * | 4/1995 | Tseng | 108/42 |
| 5,515,900 | A | * | 5/1996 | West et al. | 160/135 |
| 5,537,127 | A | * | 7/1996 | Jingu | 345/1.3 |
| 5,564,346 | A | * | 10/1996 | Robben | 108/108 |
| 5,924,367 | A | * | 7/1999 | Henke et al. | 108/108 |
| 6,196,141 | B1 | * | 3/2001 | Herron et al. | 108/108 |
| 6,205,934 | B1 | * | 3/2001 | Felton et al. | 108/107 |
| 6,434,871 | B2 | * | 8/2002 | Conway | 40/651 |
| 6,561,365 | B2 | * | 5/2003 | Bustos | 211/187 |
| 6,584,916 | B1 | * | 7/2003 | Felton et al. | 108/107 |
| 6,802,146 | B2 | * | 10/2004 | Gay | 40/651 |
| 6,819,304 | B2 | * | 11/2004 | Branson | 345/1.3 |
| 6,927,871 | B1 | * | 8/2005 | Silverbrook et al. | 358/1.15 |
| D538,093 | S | * | 3/2007 | Lee | D6/555 |
| 7,216,445 | B2 | * | 5/2007 | Bruegmann | 40/606.15 |
| 7,337,730 | B2 | * | 3/2008 | Bienick et al. | 108/108 |
| 7,371,177 | B2 | * | 5/2008 | Ellis et al. | 463/42 |
| D581,380 | S | * | 11/2008 | Derocher et al. | D14/127 |
| D600,233 | S | * | 9/2009 | Birsel et al. | D14/203.3 |
| 7,782,274 | B2 | * | 8/2010 | Manning | 345/1.3 |
| D645,467 | S | * | 9/2011 | Mitsuhashi | D14/374 |

(Continued)

*Primary Examiner* — Adrian S Wilson
(74) *Attorney, Agent, or Firm* — Richards Patent Law P.C.

(57) ABSTRACT

A modular shelving system includes: a rail including a plurality of mounting holes; a plurality of shelves, each shelf including a pair of pivot pins; a plurality of pivots removably secured to the rail, wherein each pivot receives at least one pivot pin such that each of the shelves are rotatably supported on the rail between a corresponding pair of pivots; and a plurality of covers covering the rail and spanning the distance between each corresponding pair of pivots. The shelves each include a portion of a piece of visual art, such that when each of the shelves is positioned approximately vertically, the portion of the visual art is displayed and further such that when all of the plurality of shelves are positioned in the approximately vertical position, the entirety of the visual art is displayed.

12 Claims, 15 Drawing Sheets

(56) References Cited

U.S. PATENT DOCUMENTS

| | | | | |
|---|---|---|---|---|
| 2002/0043187 | A1* | 4/2002 | Felton et al. | 108/107 |
| 2003/0006681 | A1* | 1/2003 | Herron et al. | 312/245 |
| 2003/0071832 | A1* | 4/2003 | Branson | 345/698 |
| 2003/0160755 | A1* | 8/2003 | Gettemy et al. | 345/156 |
| 2005/0088463 | A1* | 4/2005 | Schilling | 345/699 |
| 2007/0029271 | A1* | 2/2007 | Belokin et al. | 211/113 |
| 2007/0214603 | A1* | 9/2007 | Vackar | 16/330 |
| 2008/0179267 | A1* | 7/2008 | Johnson | 211/87.01 |
| 2011/0132854 | A1* | 6/2011 | Berdahl et al. | 211/59.2 |
| 2011/0204009 | A1* | 8/2011 | Karan | 211/59.2 |
| 2011/0227527 | A1* | 9/2011 | Zhu et al. | 320/108 |

* cited by examiner

SHELVING SYSTEM

CROSS-REFERENCE TO RELATED APPLICATIONS

This application incorporates by reference and claims priority to U.S. Provisional Patent Application No. 61/333,881 filed May 12, 2010.

BACKGROUND OF THE INVENTION

The present subject matter relates generally to shelving system. More specifically, the present invention relates to a multi-element, multi-position shelving system.

Shelves and shelving units are ubiquitous staples in commercial and residential design and space management. Shelves may serve aesthetic and functional purposes promoted by the materials, the geometry, the configuration, the ornamentation, etc.

Shelves often occupy wall space and/or floor space. In many environments, wall space is a prime location for visual art. In addition, floor space is often a desirable feature. To the extent a shelving unit may be adaptable to serve aesthetic and utilitarian purposes, optimizing the use of wall space between visual art and storage/function while optimizing the floor space for functionality, it may be a functional improvement over the numerous existing shelves and shelving units.

Accordingly, a need exists for a shelving system that is adaptable to serve aesthetic and utilitarian purposes, optimizing the use of wall space between visual art and storage/function while optimizing the floor space for functionality.

BRIEF SUMMARY OF THE INVENTION

The shelving system disclosed herein is adaptable to serve aesthetic and utilitarian purposes, optimizing the use of wall space between visual art and storage/function while optimizing the floor space for functionality.

In one example, a shelving system includes a plurality of pivoting shelves, each independently adapted to be positioned in a horizontal or vertical position. The shelves are pivotally mounted to one or more rails that are anchored to a wall or similar approximately vertical element. The shelving system may be adapted to include visual art independently displayed on each shelf when each shelf is placed in the approximately vertical position. Alternatively, a plurality of shelves may be grouped to display a composite piece when two or more of the shelves are placed in the approximately vertical position. The shelves can be grouped horizontally, vertically or otherwise arranged to form an approximately two or three dimensional composite form. Various shelf designs may be employed and visual art may be adapted to be displayed via the shelves using numerous techniques.

In another example, one or more shelves in the shelving system may be adapted to provide approximately horizontal and/or vertical work surfaces for a user. For example, shelves may provide approximately horizontal work surfaces for supporting items, such as computers, etc. In another example, shelves may provide approximately vertical work surfaces, such as dry-erase boards, corkboards, etc. It is understood that the shelving system may be adapted for use as a workspace in any number of environments, including, but not limited to as a kiosk for inputting golf scores in a club house, data entry in an office space, or for a registry in retail environment. Other examples of uses for the shelving system are in a library to resource books or in a work space where a group may plug in their laptop computer and view work together. The shelving system may be useful anywhere temporary or ad-hoc workspaces or storage may be desired.

Various mechanisms may be provided to secure the shelves in either the approximately horizontal or vertical position and further to secure the shelves to the rails. Moreover, various mechanism may be provided to secure items to the shelves, both the approximately vertical surfaces (e.g., visual art, work surfaces, etc.) and the approximately horizontal surfaces (e.g., items displayed on the shelves, such as electronics, jewelry, 3D artwork, etc.). Further, accommodations for cord management may be incorporated in the shelving system to better facilitate the use of the shelving system with electronic equipment. A modular shelving system includes: a rail including a plurality of mounting holes; a plurality of shelves, each shelf including a pair of pivot pins; a plurality of pivots removably secured to the rail, wherein each pivot receives at least one pivot pin such that each of the shelves are rotatably supported on the rail between a corresponding pair of pivots; and a plurality of covers covering the rail and spanning the distance between each corresponding pair of pivots. The shelves each include a portion of a piece of visual art, such that when each of the shelves is positioned approximately vertically, the portion of the visual art is displayed and further such that when all of the plurality of shelves are positioned in the approximately vertical position, the entirety of the visual art is displayed.

An advantage of the shelving system is visual art may be displayed when one or more shelves are in the vertical position.

Another advantage of the shelving system is floor space may be conserved when one or more shelves are in the vertical position.

A further advantage of the shelving system is in providing an adaptable composite visual aesthetic.

Yet another advantage of the shelving system is in providing temporary and/or ad hoc workspace.

Still another advantage of the shelving system is in providing a visually appealing functional solution for commercial and residential space management.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
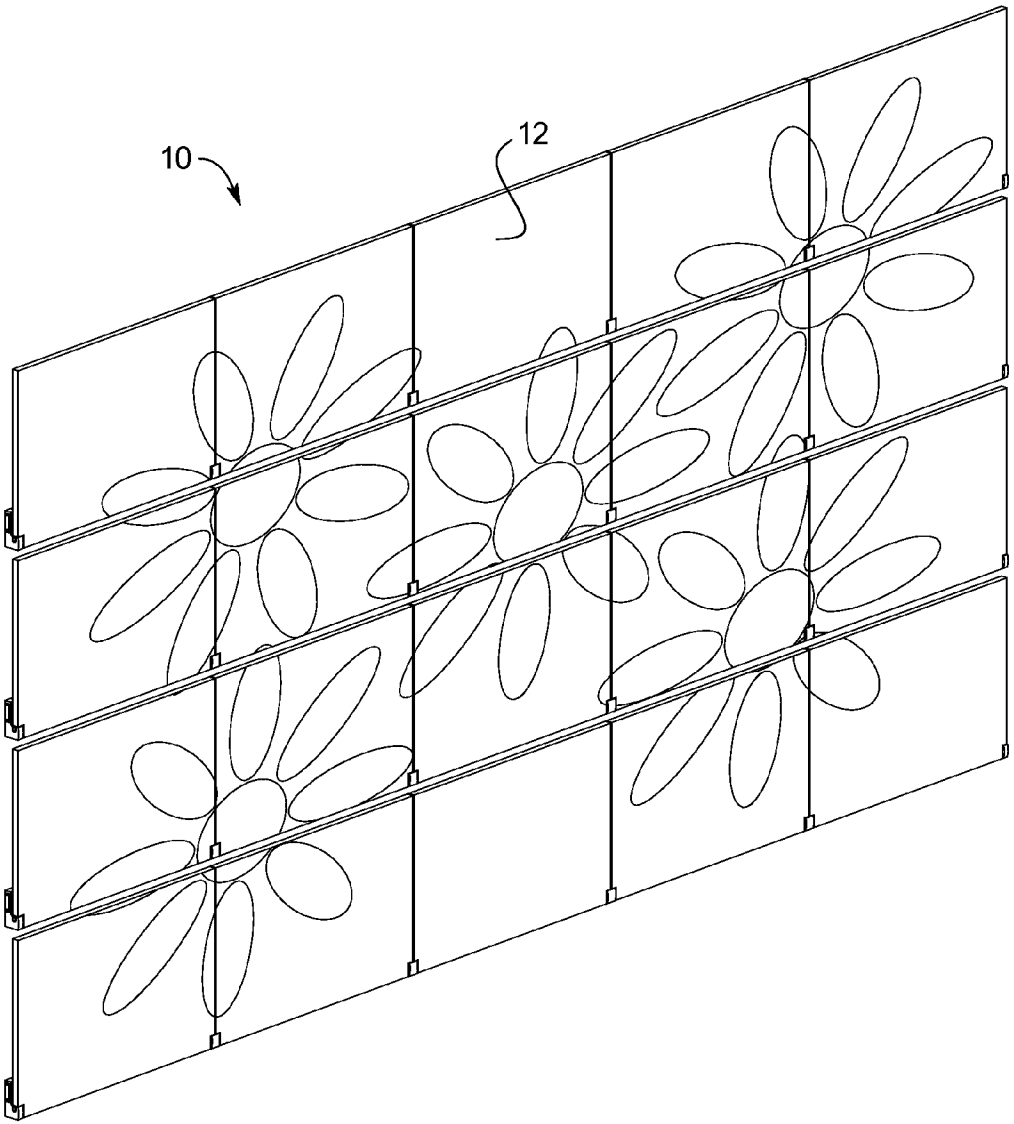
FIG. 1 is a perspective view of an example of a shelving system as disclosed herein.

The shelving system 10 shown in FIG. 1 includes a plurality of shelves 12. In the example shown in FIG. 1, the shelving system 10 includes twenty shelves 12, each shown in a vertical orientation. As shown, the each of the shelves 12 cooperates to display a visual image, wherein each shelf 12 contributes to the overall composition.

Figure 2:
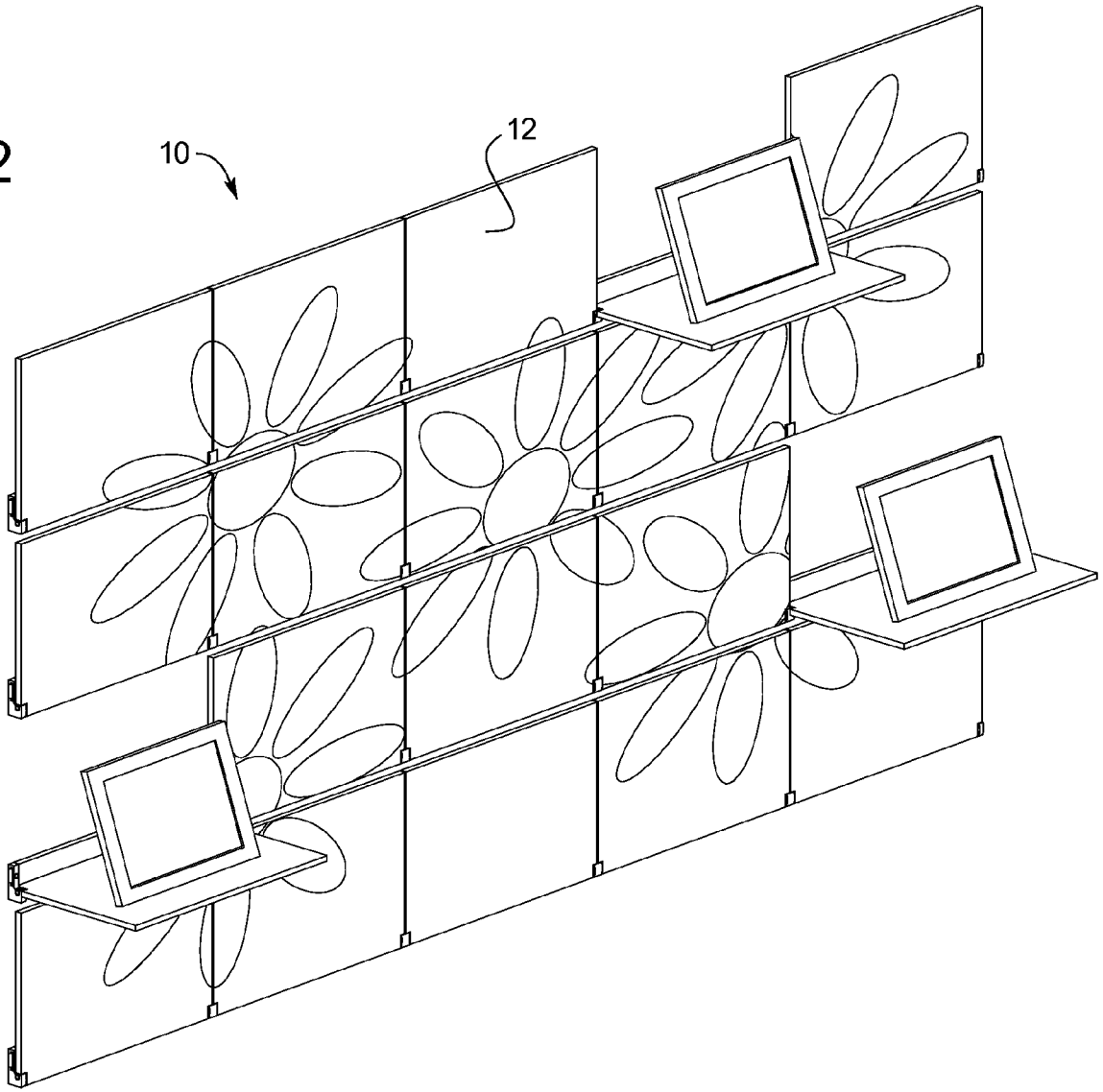
FIG. 2 is a perspective view of the shelving system shown in FIG. 1, wherein several of the shelves are positioned horizontally to hold items thereon and other shelves are positioned vertically.

FIG. 2 illustrates the shelving system 10 shown in FIG. 1, with four of the shelves 12 shown in a horizontal orientation. As shown, the horizontally oriented shelves 12 are configured to support items, while the remaining vertically oriented shelves 12 cooperate to display a portion of the visual image. As shown, any number of the shelves 12 in the shelving system 10 may be oriented vertically or horizontally.

Figure 3:
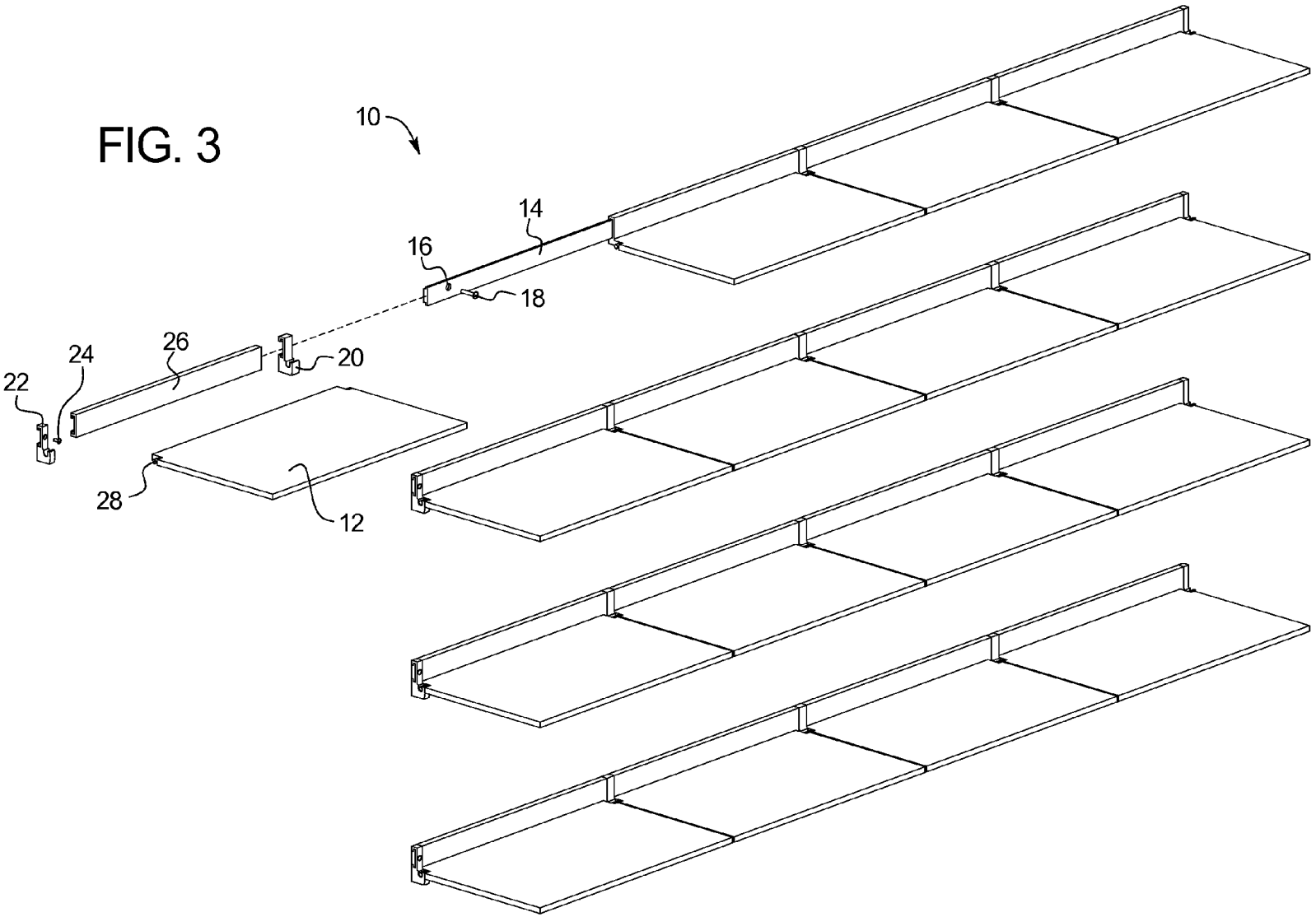
FIG. 3 is an exploded view of another shelving system as disclosed herein.

FIG. 3 illustrates another example of a shelving system 10. In the example shown in FIG. 3, the shelving system 10 includes: a plurality of shelves 12; a plurality of rails 14, including mounting holes 16; a plurality of anchor bolts 18 securing the rails into the wall; a plurality of middle pivot supports 20; a plurality of end pivot supports 22; set screws 24 attaching the pivot supports 20 and 22 to the rails 14; and a plurality of covers 26. Some of the elements of the shelving system 10 are shown in a closer view in FIG. 4.

Figures 4, 5:
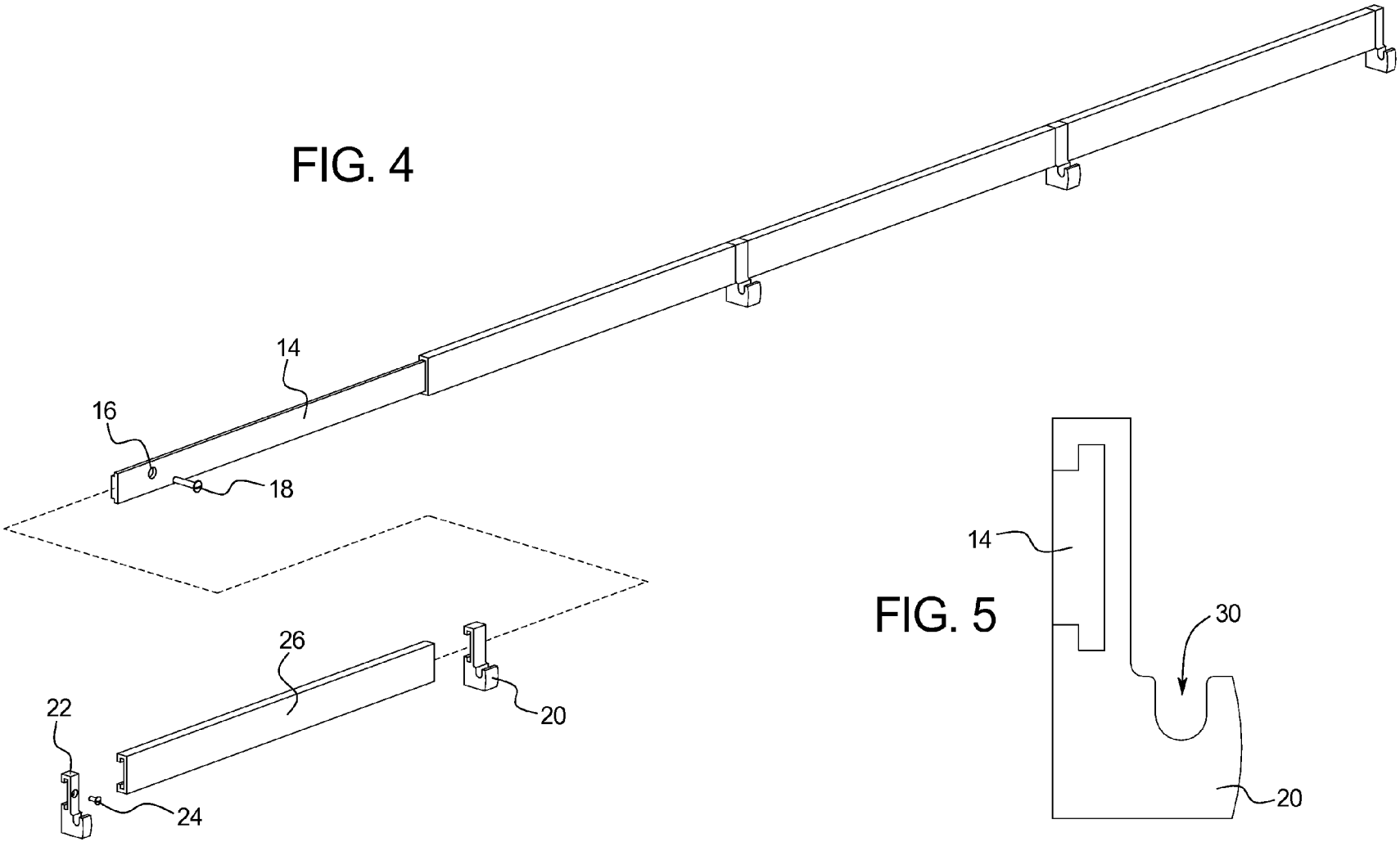
FIG. 4 is an exploded view of a rail and pivot attachments of the shelving system shown in FIG. 3.
FIG. 5 is a cross-sectional side view of a rail and cover attachment from the shelving system shown in FIG. 3.

In the example shown in FIGS. 3 and 4, there are four rails 14 anchored to the wall. Each of the rails 14 supports a group of four shelves 12. However, it is understood that any number of rails 14 can support any number of shelves 12. In addition, the rails 14 may be configured in number and geometry to form various shapes and proportions. Further, the shelves 12 may be provided in varying sizes and shapes such that the combination of shelves 12 may be used to provide various configurations and visual effects.

As shown in FIGS. 3 and 4, the pivot supports 20 and 22 are configured as middle pivot supports 20 and end pivot supports 22. In the example shown, the middle pivot supports 20 are approximately twice as wide as the end pivot supports 22 in order to support two shelves 12 with each middle pivot support 20. However, it is understood that in certain embodiments, the pivot supports 20 and 22 may be identically designed.

The pivot supports 20 and 22 may be securely attached to the shelving system 10 using clips, screws or a locking mechanism to help prevent dislocating during seismic activity, user collision or theft.

The covers 26 shown in FIGS. 3 and 4 are used to provide an aesthetic cover to the rail 14 when the shelving system 10 is assembled. In addition, the covers 26 may protect the accidental or intentional tampering with the anchor bolts 18 holding the rail 14 to the wall. It is understood the cover 26 may increase the durability and the attractiveness of the shelving system 10. However, alternate examples of the shelving system 10 may or may not include covers 26.

In the examples shown in FIGS. 3 and 4, the cover 26 serves the functional purpose of limiting the rotation of the shelves 12. When the shelf 12 is rotated to the approximately horizontal position, the top surface of the shelf 12 comes into contact with the cover 26, which prevents further rotation of the shelf 12 and maintains the shelf 12 in the horizontal position. It is contemplated that in other embodiments of the shelving system 10, the rotation of the shelf may be limited by the rail 14 or by other mechanisms.

The shelves 12 shown in FIG. 3 include pivot pins 28 which pivotally attach the shelves 12 to the pivot supports 20 and 22, as described further herein.

The example of the shelving system 10 shown in FIGS. 3 and 4 is substantially formed from extruded aluminum. For example, the rails 14 and the shelves 12 may be formed from extruded aluminum. However, it is understood that the shelving system 10 may be formed from any number of materials and combination of materials. For example, the shelves 12 may be made from sheet aluminum or sheet steel. Alternatively, the shelves 12 may be made from formed aluminum. Additionally, the shelves 12 and/or rail 14 may be formed from wood. It is further understood that the shelving system 10 may incorporate elements made from polymers, composites, carbon fiber, etc.

FIG. 5 is a cross-sectional view of a shelving system 10 where a middle pivot support 20 attaches to a rail 14. As shown in FIG. 5, the pivot support 20 provides a channel 30 within which the pivot pins 28 of the shelves 12 may be supported. As shown, the width of the channel 30 at the top of the channel 30 may be narrower than the width deeper into the channel 30. The narrowest width of the channel 30 may be approximately the same dimension as or slightly narrower than the diameter of the pivot pins 28. Accordingly, the channel 30 may secure the pivot pins 28 in a snap-fit mechanism. The materials used to construct the pivot supports 20 and 22 and/or pivot pins 28 may further effect the snap-fit attachment.

Although shown as a snap-fit attachment between pivot supports 20 and 22 and pivot pins 28, it is contemplated that the shelves 12 may be supported in any number of ways that enable the shelves 12 to pivot between an approximately horizontal and an approximately vertical orientation.

It is contemplated that the shelving system 10 may be implemented in environments where the "vertical" wall is not actually vertical. In these environments, the pivot supports 20 and 22 may be configured to allow the shelves 12 to pivot between vertical and horizontal. Alternatively, the pivot supports 20 and 22 may be adapted to allow the shelves 12 to pivot between parallel to the wall surface and horizontal, to support items on the shelves 12, whether the angle between the two is less than or greater than ninety degrees. It is further understood that the shelves 12 may be adapted to pivot between additional positions and orientations.

Figure 6:
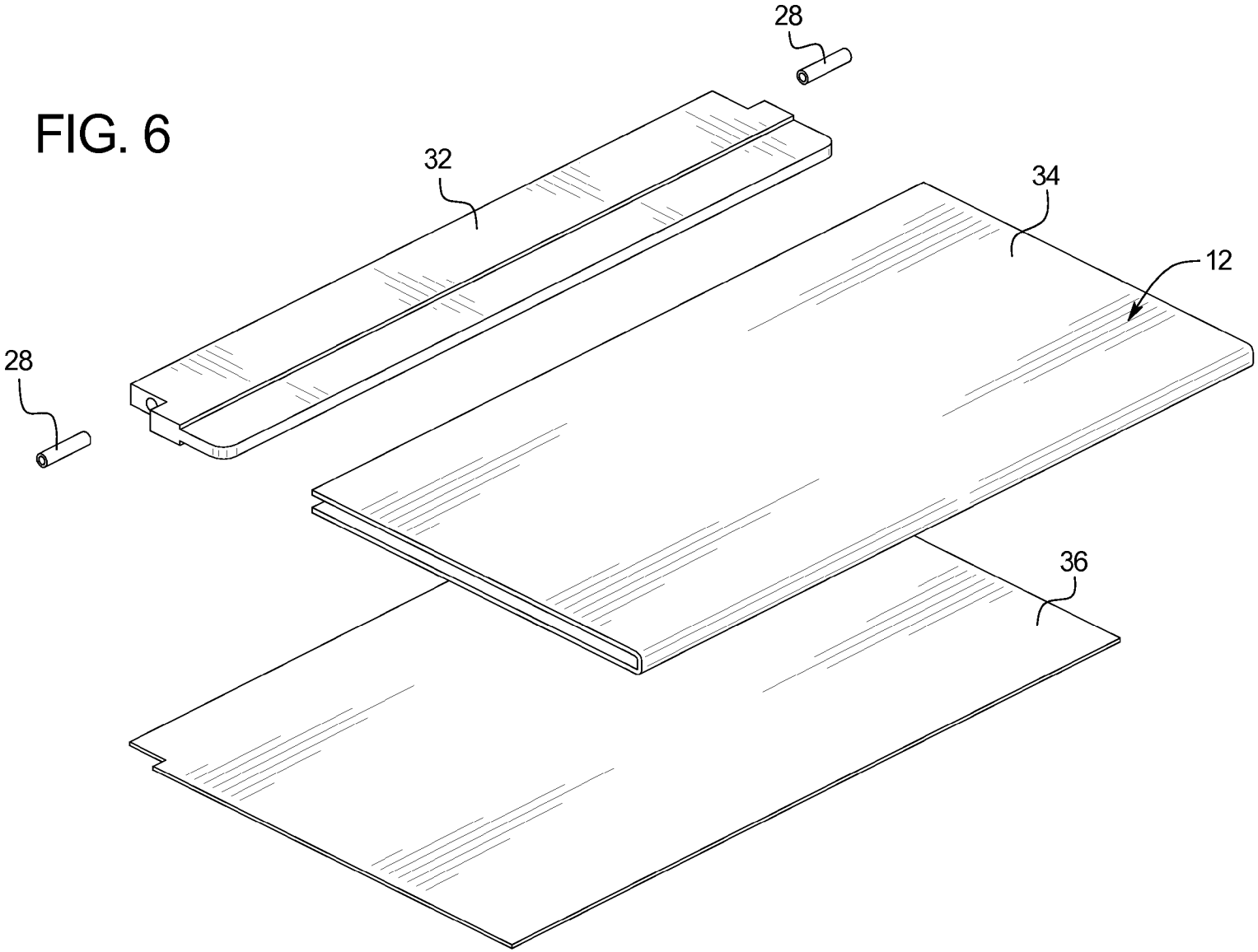
FIG. 6 is an exploded perspective view of a shelf of a shelving system as disclosed herein.

FIG. 6 illustrates and exploded view of a shelf 12 made from the combination of an extruded aluminum base 32 and a shelf body 34 formed from sheet aluminum. Additionally, the shelf 12 shown in FIG. 6 includes adhesive vinyl artwork 36 to be attached to the shelf 12. FIG. 6 is merely one example of a shelf 12 that may be incorporated into the shelving system 10 and merely one example of attaching artwork to a shelf 12. For example, the artwork may be etched into the shelf 12 or otherwise incorporated into the shelf 12 itself.

Figure 7:
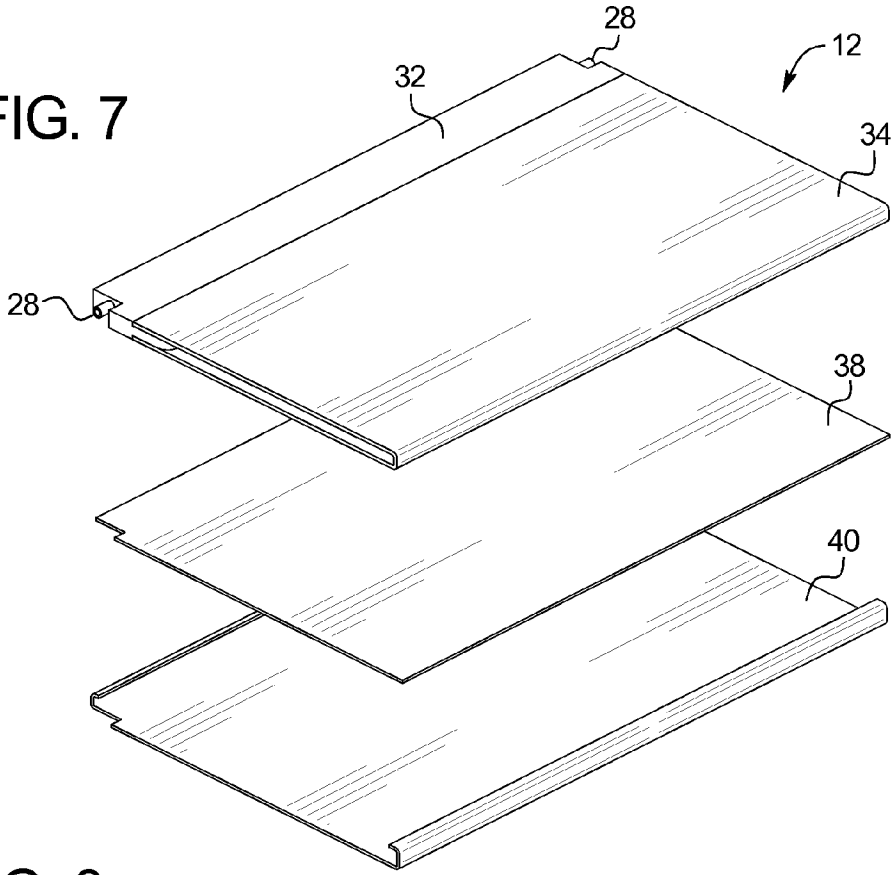
FIG. 7 is an exploded perspective view of another shelf of a shelving system as disclosed herein.
Figure 8:
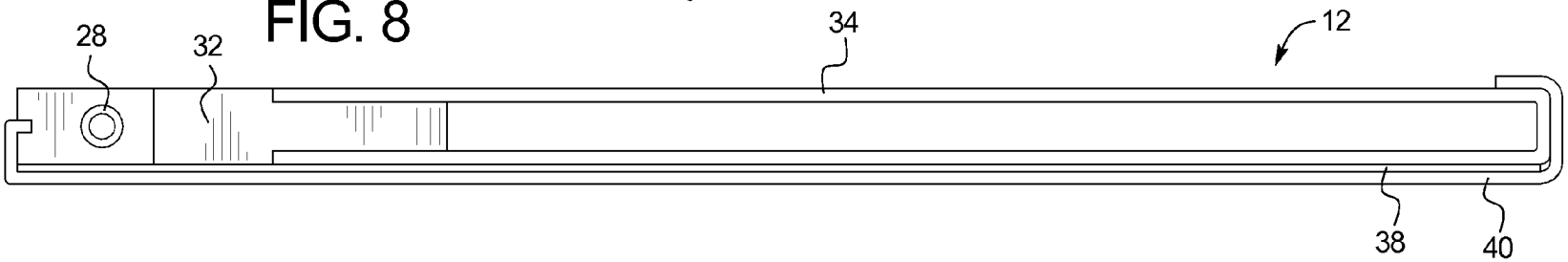
FIG. 8 is a cross-sectional side view of the shelf shown in FIG. 7.

FIGS. 7 and 8 illustrate another example of how artwork may be attached to a shelf 12. In the example shown in FIGS. 7 and 8, the shelf assembly includes an artwork sheet 38 that is secured to the shelf 12 by a formed clear acrylic protective sleeve 40. The assembly shown in FIGS. 7 and 8 is an example of a shelf 12 that may facilitate interchanging of artwork sheets 38.

Figure 9:
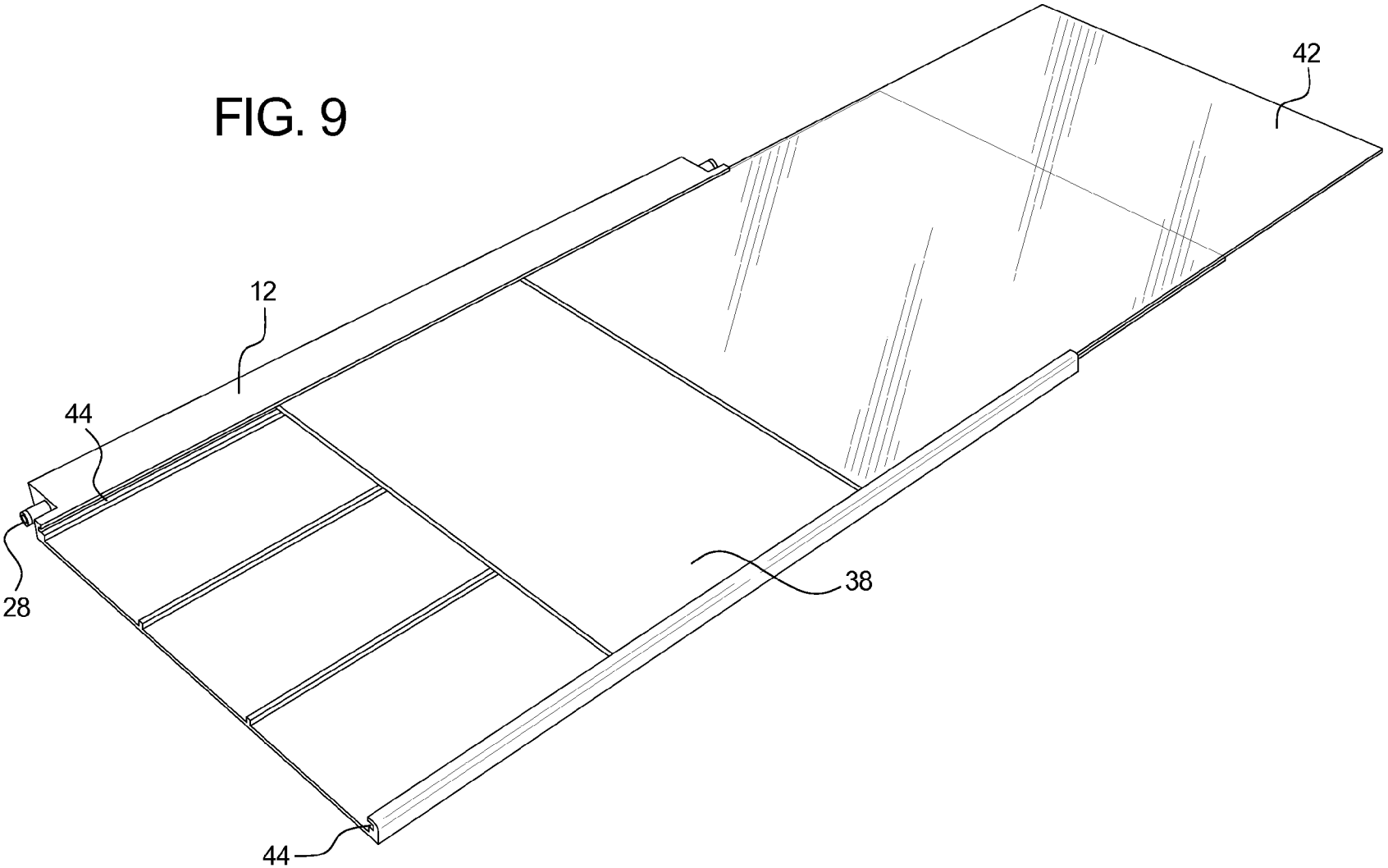
FIG. 9 is a perspective view of another shelf of a shelving system as disclosed herein.

FIG. 9 illustrates another example of how artwork may be attached to a shelf 12. In the example shown in FIG. 9, the shelf assembly includes an artwork sheet 38 that is secured to the shelf 12 by a formed clear protective sheet 42. The protective sheet 42 slides into the shelf 12 in channels 44 to secure the artwork 38 sheet therein. The assembly shown in FIG. 9 is another example of a shelf 12 that may facilitate interchanging of artwork sheets 38.

The protective sleeve 40 and the protective sheet 42 are merely two examples of protective covers for protecting artwork from physical and/or from UV degradation. It is further contemplated that other configurations of protective covers may be employed in the shelving system 10. Alternative embodiments may be clear, may be translucent and/or colored, or may be the artwork themselves.

Figure 10:
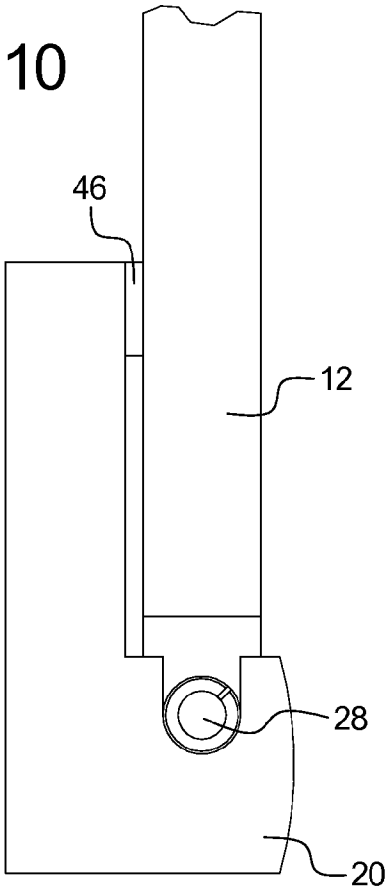
FIG. 10 is a side view of another shelving system as disclosed herein.

FIG. 10 illustrates an example of a shelving system 10 in which a magnet 46 is used to secure the shelf 12 in the vertical orientation. The shelf 12 shown in FIG. 10 is formed from steel or other ferromagnetic material. The use of a magnet 46 and a ferromagnetic shelf 12 enable the shelf 12 to be secured in an upright position without it accidentally moving out of the upright position. A further advantage of using a ferromagnetic shelf 12 is that the shelf 12 may be used with magnetic artwork, signage, tiles, panels, etc. It is further contemplated that other securing mechanisms may be employed to secure the shelf 12 in one or more orientations.

Figure 12:
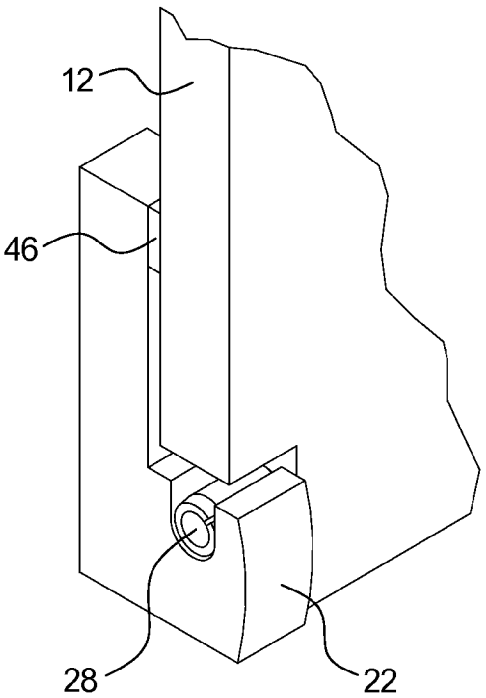
FIGS. 11 and 12 are perspective views illustrating how the shelf shown in FIG. 10 mounts within the shelving system.
Figure 11:
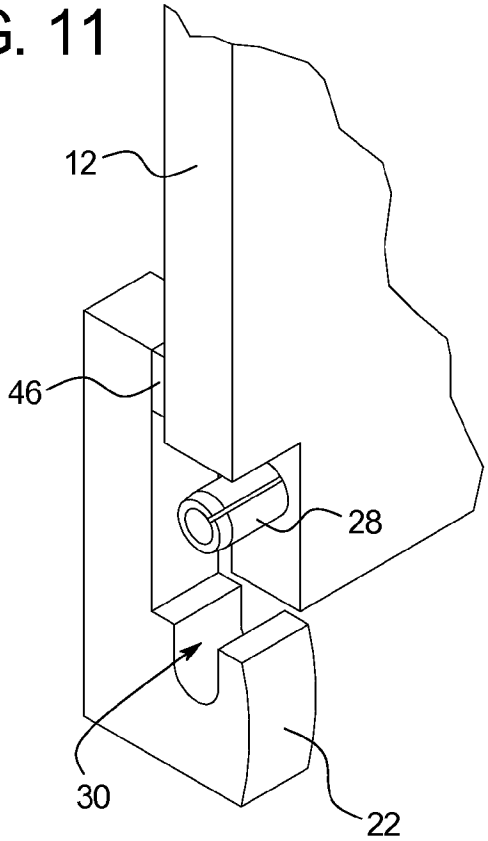

FIGS. 11 and 12 illustrate how a shelf 12 mounts within the channel 30 of an end pivot support 22. As described above, the pivot pin 28 of the shelf 12 may be lowered into the channel 30 and snapped into place. The shelf 12 may then rotate freely between a vertical and a horizontal orientation, with the magnet 46 securing the shelf 12 in the vertical orientation.

Figure 13B:
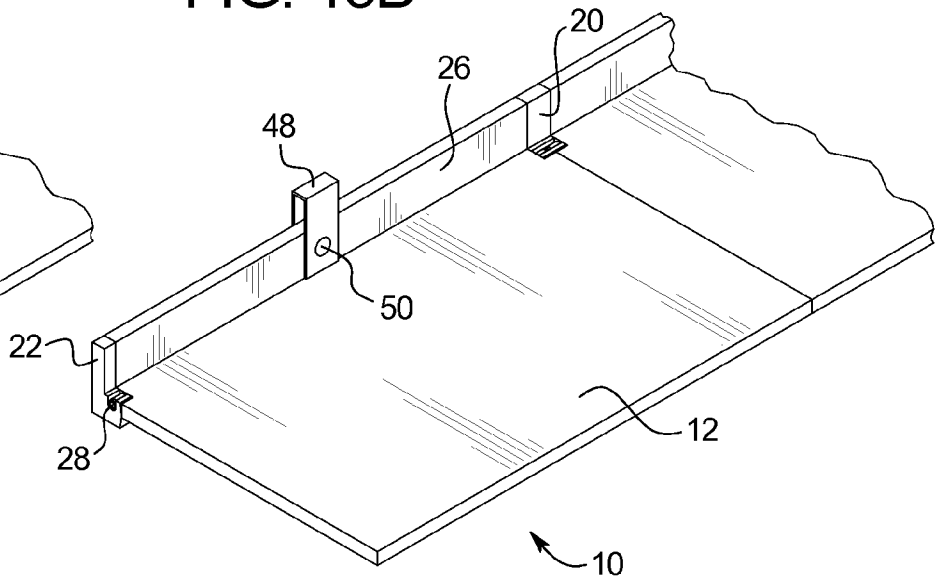
FIGS. 13A and 13B are perspective views of another shelf of a shelving system as disclosed herein.
Figure 13A:
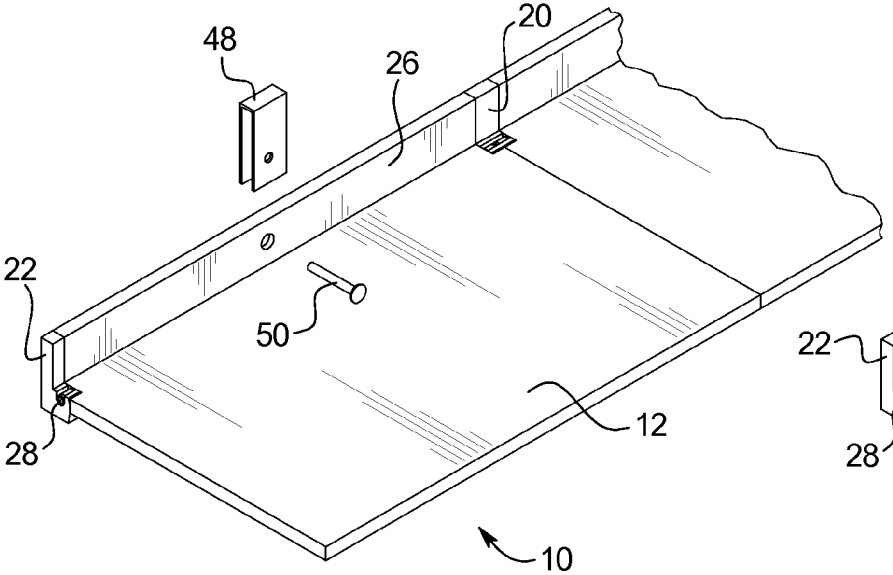

FIGS. 13A and 13B illustrate one example of a security bracket 48 that may be secured to the shelving system 10, for example, by bolting the security bracket 48 to the cover 26 with a security bolt 50. In the example shown in FIGS. 13A and 13B, the security bolt 50 passes through the rail 14 and anchors into the wall. The security bracket 48 enables valuable items to be secured to the shelving system 10, such as, for example, such as electronics, jewelry, 3D artwork, etc.

Figure 14:
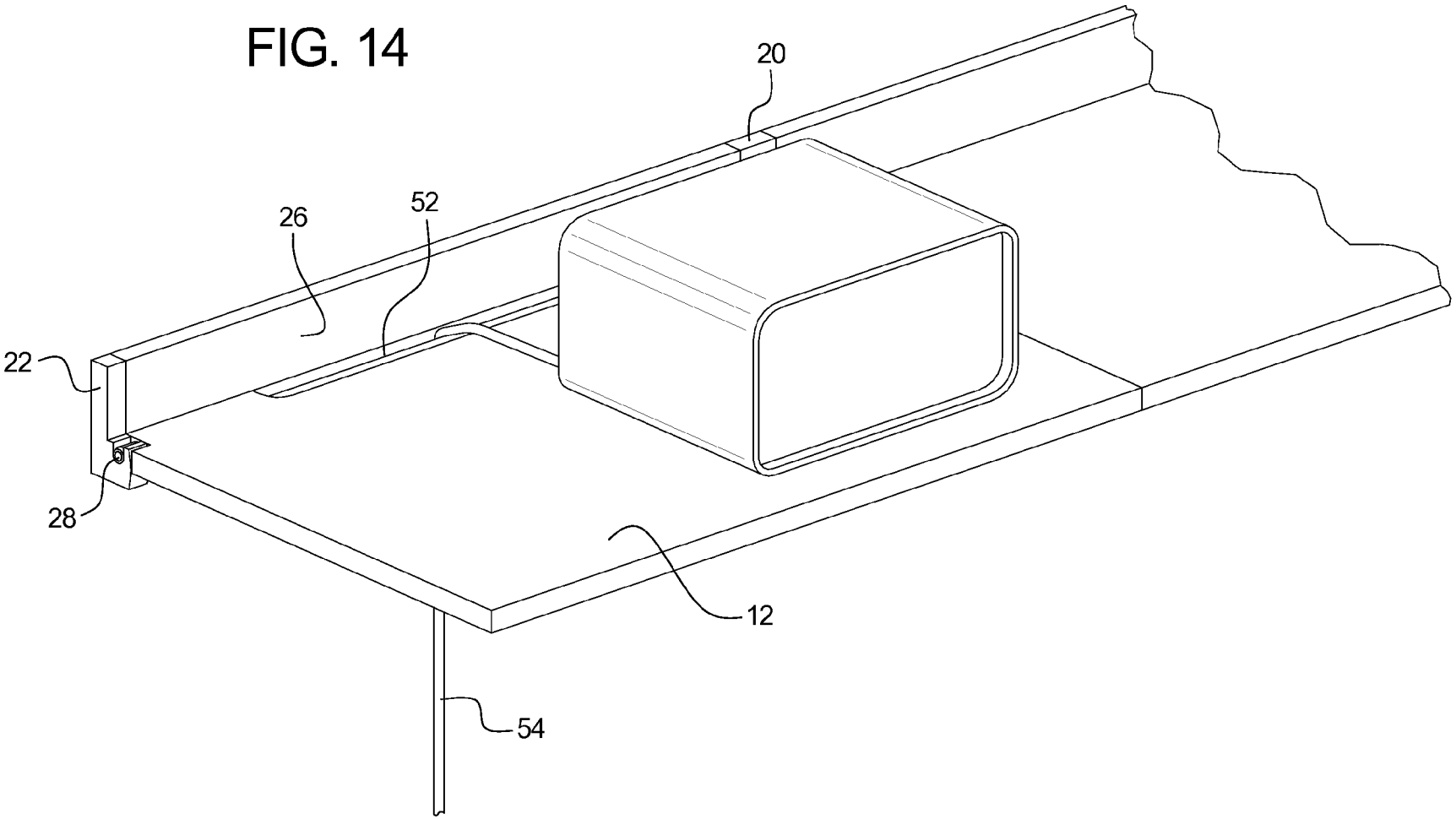
FIG. 14 is a perspective view of another shelf of a shelving system as disclosed herein.

FIG. 14 illustrates an example of how a shelving system 10 may be adapted for use with electronic equipment. In the example shown in FIG. 14, a slot 52 is provided where the shelf 12 abuts the cover 26 such that an electronic cord 54 may be neatly passed through the shelf 12. In other contemplated examples, the cord 54 may be passed within the cover 26, within a covered channel (not shown) or other adapted cord management system.

Figure 15:
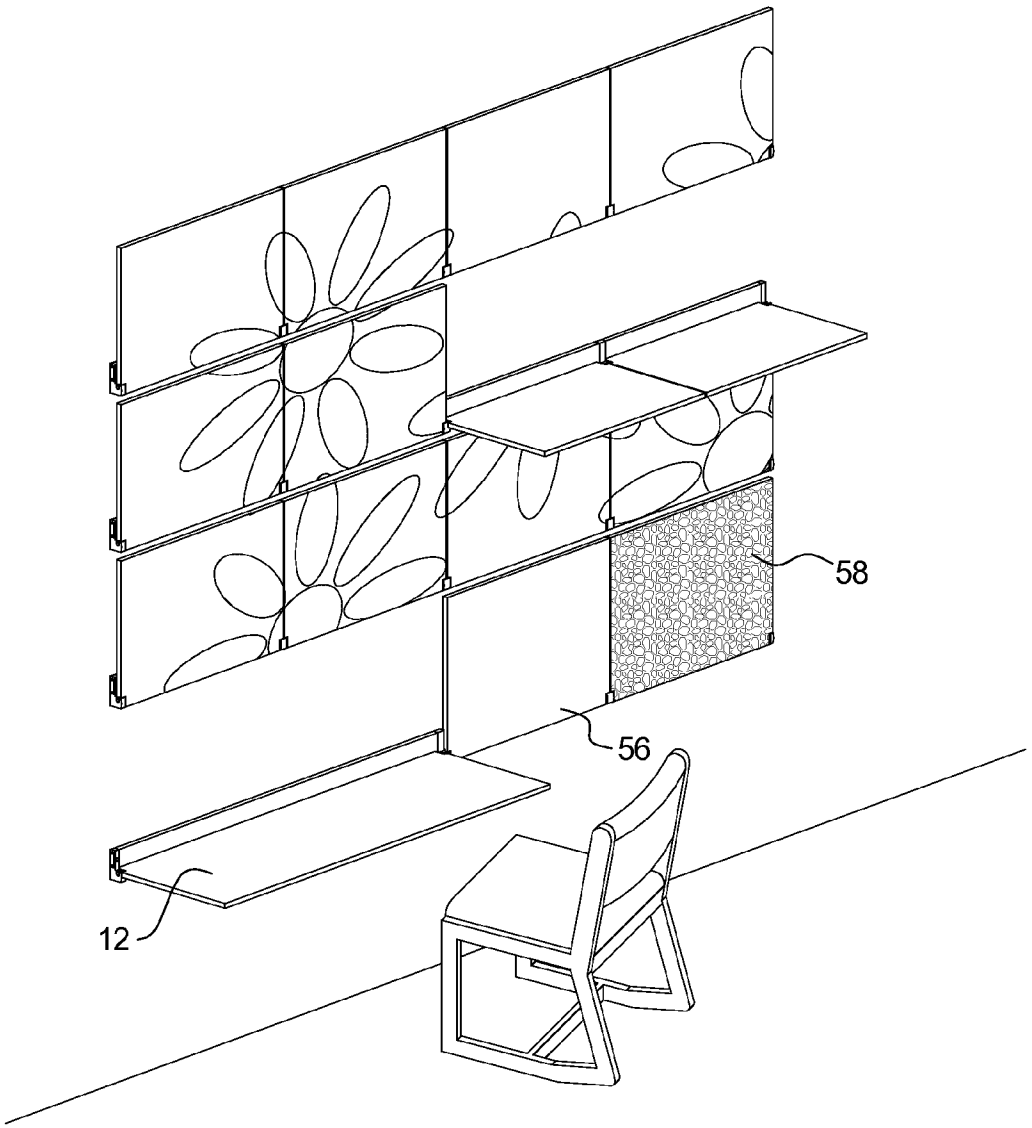
FIG. 15 is a perspective view of another shelf of a shelving system as disclosed herein.

FIG. 15 illustrates an example of a shelving system 10 adapted for use in a hot desking environment. As shown in FIG. 15, the shelving system 10 includes various sizes of shelves 12, including a wide shelf 12 for use as a horizontally oriented workspace. In addition, the shelving system 10 includes a white board 56 and a corkboard 58, each of which provides a vertically oriented workspace. The remaining shelves 12 include artwork to form composite visual art. The shelving system 10 shown in FIG. 15 may be particularly advantageous in environments in which temporary desks or workspaces may be needed.

Figure 16:
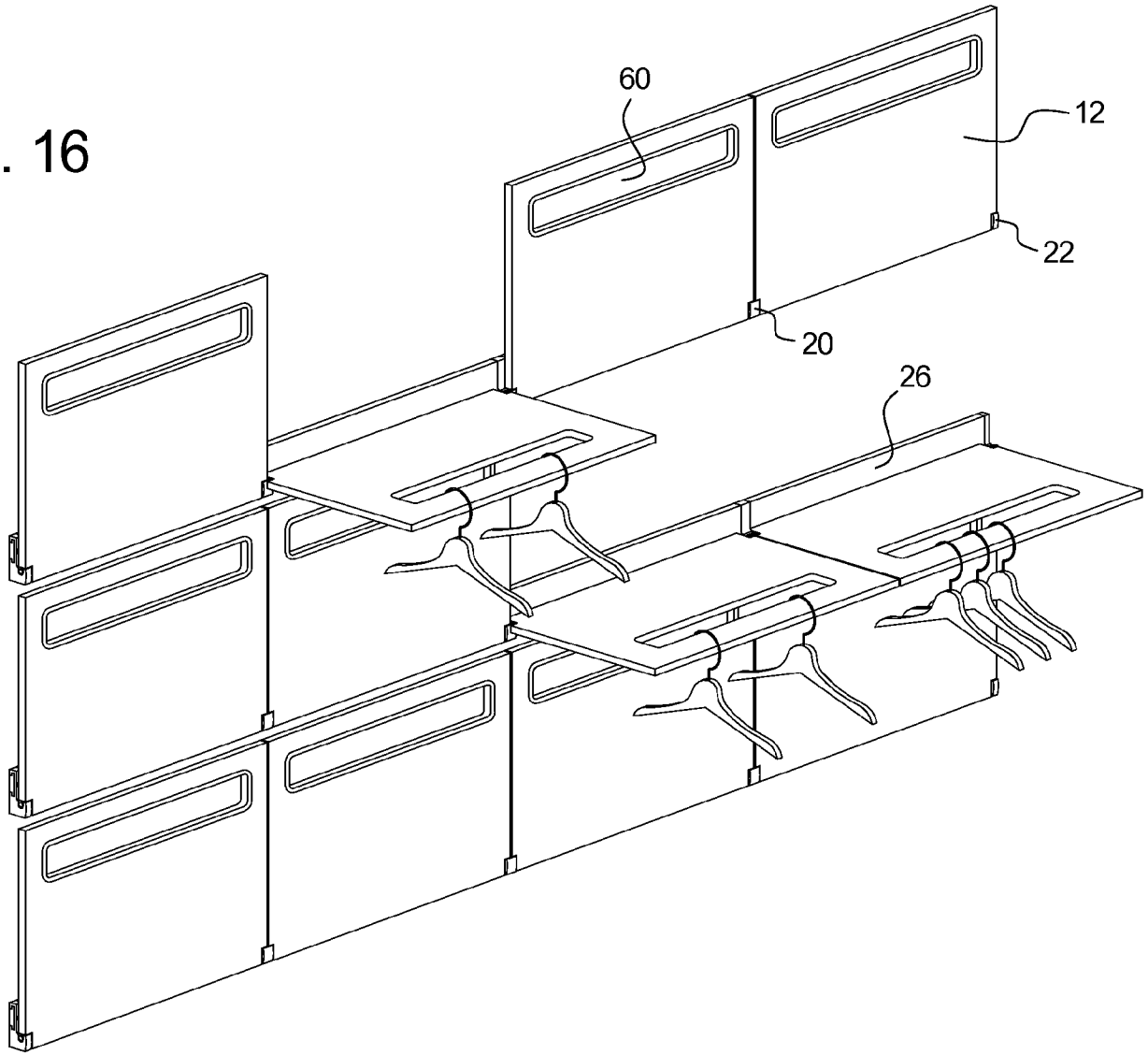
FIG. 16 is a perspective view of another shelf of a shelving system as disclosed herein.

FIG. 16 is an example of a shelving system 10 that may be of particular use in a retail environment. As shown in FIG. 16, the shelves 12 may incorporate an opening 60 from which hangers may be suspended. Accordingly, a unique configuration of hanging clothes may be arranged within visual art. The shelving system 10 shown in FIG. 16 may also be advantageously used in a hotel room where the shelving system 10 provides visual art and functional shelving and hangers for hanging clothing.

Figure 17:
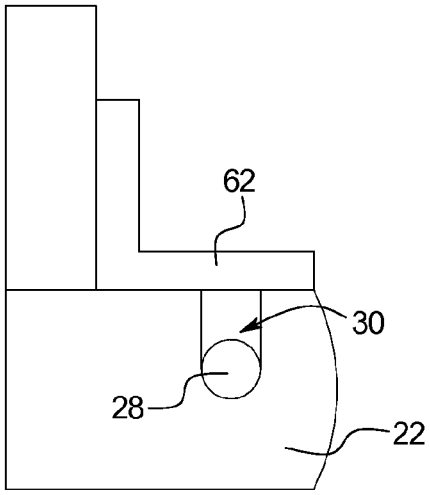
FIGS. 17-19 are cross-sectional side views of various locking mechanisms for use in shelving systems as disclosed herein.
Figure 18:
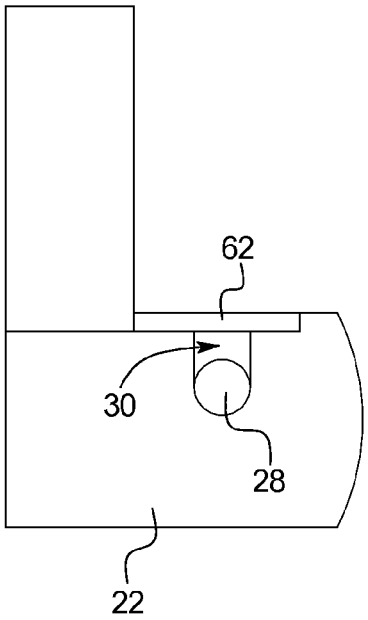
Figure 19:
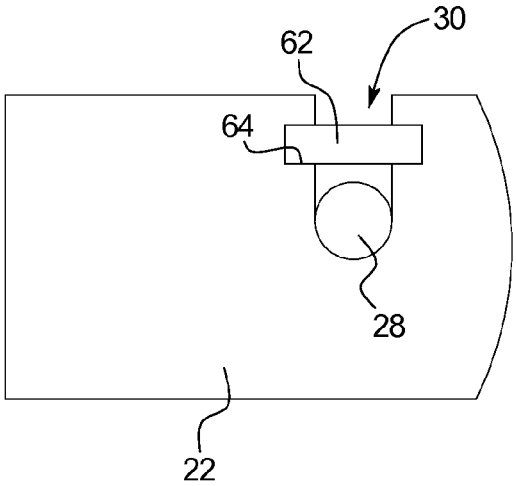

FIGS. 17-19 illustrate examples of locking mechanisms 62 that may be employed to assist in holding the pivot pin 28 within the channel 30 of the pivot support 20 or 22. The examples shown demonstrate that various configurations of locking mechanisms may be employed, for example, to resist seismic events. In the example shown in FIG. 19, the pivot support 20 or 22 includes a slot 64 for receiving a slide in locking mechanism 62. As shown, any number of locking mechanisms 62 may be employed to secure the pivot pin 28 in the channel 30.

In the embodiments of the shelving system 10 shown in FIGS. 1-19, the pivot supports 20 and 22 and the shelves 12 may be provided in fixed positions or may be slidable along the rail 14 to be arranged in various configurations. If slidable, the pivot supports 20 and 22 and the shelves 12 may be locked into place, for example, using anchors, locks, etc. The slidable shelves 12 make the shelving system 10 modular and/or mobile, while being attached to a wall.

It is further contemplated that various portions or combinations of the shelving system 10 described herein as separate elements, for example the rail 14 and the pivot supports 20 and 22, may be formed as unitary elements.

Figure 20:
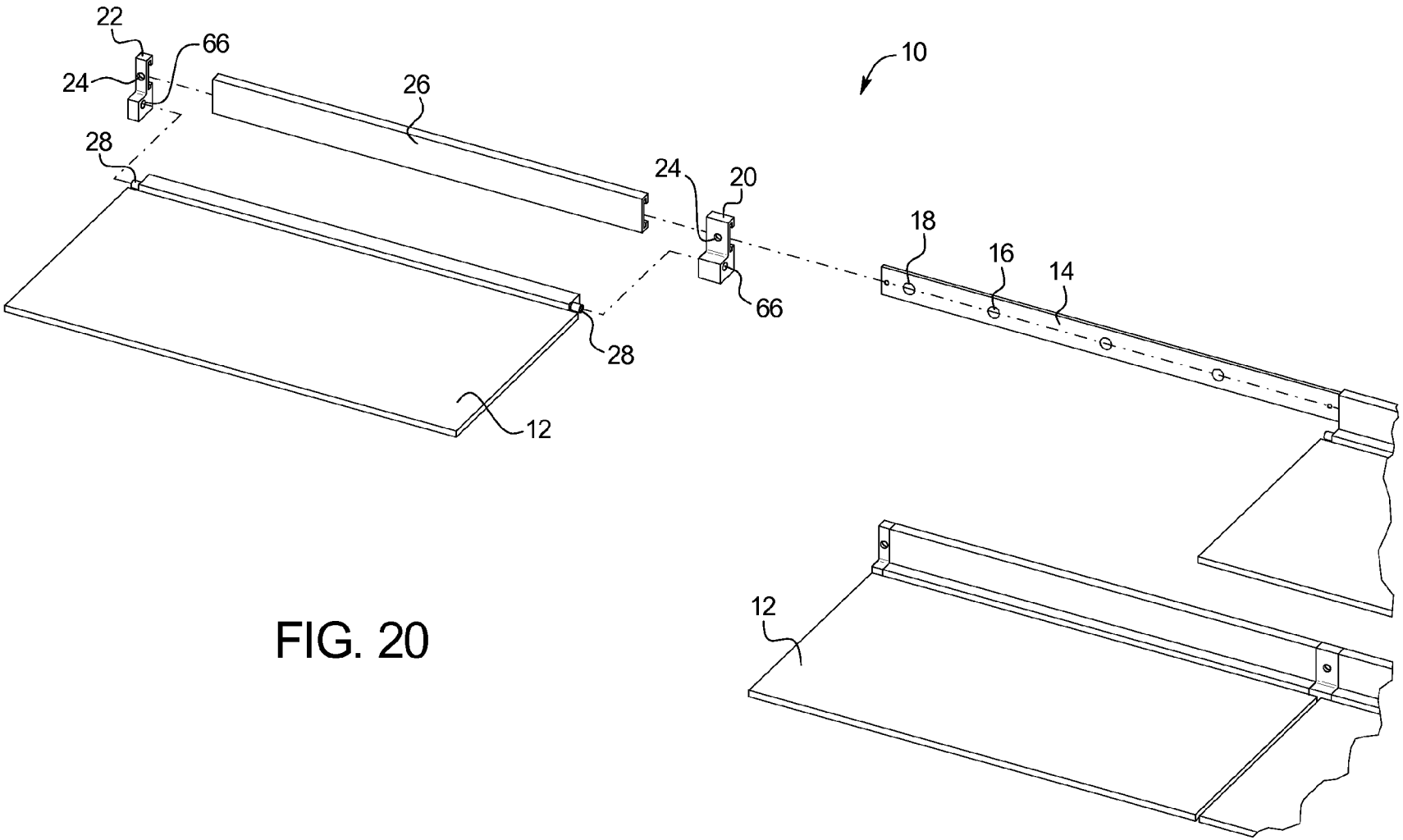
FIGS. 20-21 are perspective views of a preferred embodiment of the shelving system.
Figure 21:
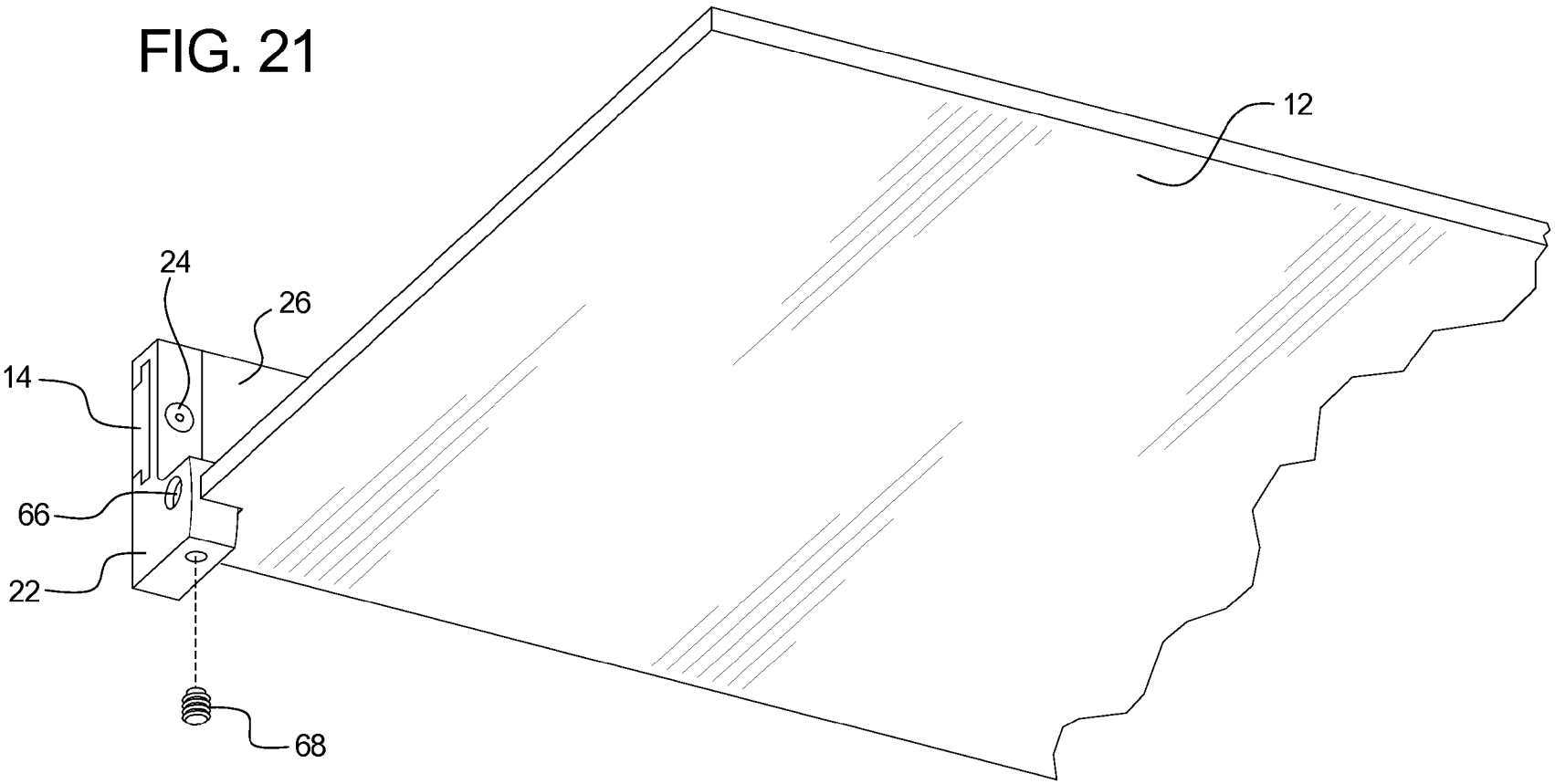

A preferred embodiment of the shelving system 10 is shown in FIGS. 20 and 21. As shown in FIGS. 20 and 21, the shelving system 10 includes a plurality of shelves 12; a plurality of rails 14, including mounting holes 16; a plurality of anchor bolts 18 securing the rails into the wall; a plurality of middle pivot supports 20; a plurality of end pivot supports 22; set screws 24 attaching the pivot supports 20 and 22 to the rails 14; and a plurality of covers 26.

The example shown in FIGS. 20 and 21, the pivot supports 20 and 22 include receiving holes 66 for receiving the pivot pins 28, rather than the channels 30 shown in other illustrated embodiments of pivot supports 20 and 22. As shown, the receiving holes 66 surround the pivot pins 28 and allow the shelves 12 to pivot freely within the pivot pins 20 and 22. The receiving holes 66 allow axial rotation while preventing translation of the pivot pins 28 out of the pivot supports 20 and 22.

As shown in FIG. 21, the pivot supports 20 and 22 include set screws 68 threaded through the lower surface of the pivot supports 20 and 22 into the receiving holes 66 for interaction with the pivot pins 28. The middle pivot supports 22 may include a pair of set screws 68, one for each pivot pin 28 and the end pivot supports 22 may include a single set screw 68 for the single pivot pin 28 located therein.

In use, the pivot pins 28 may be located into the receiving holes 66. Then, the corresponding set screws 68 may be tightened against the pivot pins 28 to create resistance to rotation. The tighter the set screws 68 are tightened, the more resistance there is to rotational movement of the shelves 12. The set screws 66 may be tightened such that the shelves 12 are essentially "locked" into a given position.

Although described above with reference to numerous examples and variations, it is contemplated that there are nearly limitless configurations into which the inventive subject matter described herein may be incorporated. For example, the shelves 12 may be provided as frames into which a plurality of video screens (e.g., LCD screens) forming a composite display. The video screens may be adapted such that they are switched on when placed in the upright "viewing" position and off when positioned in the horizontal position. In another example, the shelves 12 may include an inductive charging station such that when the shelf 12 is in the vertical position the station is switched off and when the shelf 12 is in the horizontal position it may be used to inductively charge electronic devices placed thereon. Many additional examples will be apparent to those skilled in the art based on the disclosure provided herein.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A modular shelving system comprising:

a rail including a plurality of mounting holes, wherein the rail is mounted to a wall;

a plurality of shelves, each shelf including a pair of cylindrical pivot pins, wherein each of the pair of cylindrical pivot pins extend outward from the shelf in opposing directions and from opposing sides of the shelf;

a plurality of pivots removably secured to the rail, wherein each pivot receives at least one pivot pin such that each of the shelves are rotatably supported on the rail between a corresponding pair of pivots; and a plurality of covers covering the rail and spanning the distance between each corresponding pair of pivots, wherein the plurality of shelves support the placement of objects thereon when oriented horizontally.

2. The modular shelving system of claim 1 wherein the plurality of shelves each include a top surface and a bottom surface, wherein the bottom surface of each of the plurality of shelves includes a portion of a piece of visual art, such that when each of the shelves is positioned approximately vertically, the portion of the visual art is displayed and further such that when all of the plurality of shelves are positioned in the approximately vertical position, the entirety of the visual art is displayed.

3. The modular shelving system of claim 1 wherein each pivot includes a channel that receives a corresponding pivot pin.

4. The modular shelving system of claim 1 wherein each pivot includes at least one receiving hole that receives a corresponding pivot pin.

5. The modular shelving system of claim 4 wherein each pivot includes a set screw extending into the receiving hole to contact the pivot pin, wherein tightening the set screw increases the corresponding shelf's resistance to rotation.

6. The modular shelving system of claim 1 wherein, when rotated to a near horizontal position, a top surface of each shelf contacts a lower surface of the rail, limiting the rotation of each shelf.

7. The modular shelving system of claim 1 wherein the plurality of pivots include a plurality of end pivots and at least one middle pivot, wherein the middle pivot engages a pivot pin from each of two shelves and the end pivots engage a pivot pin from one shelf.

8. The modular shelving system of claim 1 wherein the plurality of shelves and rail are magnetically attracted such that when each shelf is located in a near vertical position, the magnetic attraction works to hold the shelf in place against the cover.

9. The modular shelving system of claim 1 wherein at least one shelf incorporates an electronic device.

10. The modular shelving system of claim 9 wherein the electronic device is powered on and off by rotating the shelf between a first position and a second position.

11. The modular shelving system of claim 10 wherein the electronic device is a video screen.

12. The modular shelving system of claim 10 wherein the electronic device is an inductive charging station.

* * * * *